US011174129B1

(12) United States Patent
Jackson et al.

(10) Patent No.: US 11,174,129 B1
(45) Date of Patent: Nov. 16, 2021

(54) INTEGRATED ELEVATOR SILL DRAIN

(71) Applicant: HIGH RISE SOLUTIONS, LLC, Nashville, TN (US)

(72) Inventors: William Brandon Jackson, Columbia, TN (US); Donald B. Orr, Nashville, TN (US)

(73) Assignee: High Rise Solutions, LLC, Nashville, TN (US)

( * ) Notice: Subject to any disclaimer, the term of this patent is extended or adjusted under 35 U.S.C. 154(b) by 403 days.

(21) Appl. No.: 16/171,820

(22) Filed: Oct. 26, 2018

(51) Int. Cl.
*B66B 13/30* (2006.01)
*E06B 1/70* (2006.01)
*B66B 19/00* (2006.01)

(52) U.S. Cl.
CPC ..... *B66B 13/301* (2013.01); *B66B 19/007* (2013.01); *E06B 1/70* (2013.01)

(58) Field of Classification Search
CPC ..... B66B 13/301; B66B 19/007; E06B 1/70; E03F 5/0407; E03F 5/06; Y10T 137/6988
USPC ..... 49/471
See application file for complete search history.

(56) References Cited

U.S. PATENT DOCUMENTS 630,533 A * 8/1899 Fiske ..... A01K 1/0151 119/528
2,701,027 A * 2/1955 Scoville ..... E01C 11/227 210/163
2,944,671 A * 7/1960 Loffler ..... E03C 1/29 210/166
5,230,188 A * 7/1993 Nurse ..... A47L 23/28 210/163
D355,707 S * 2/1995 Emanuele ..... E03F 5/0407 D23/259
9,777,489 B2 10/2017 Gomo et al.
9,834,894 B1 * 12/2017 Reed ..... E03F 5/0401
10,501,926 B2 * 12/2019 Priester ..... E03F 5/0407
2006/0054419 A1 * 3/2006 Friedman ..... B66B 13/301 187/211
2011/0067175 A1 * 3/2011 Steylaerts ..... E03F 5/0408 4/679
2011/0162137 A1 * 7/2011 Kik, Sr. ..... E03F 3/046 4/613
2012/0266968 A1 10/2012 Bloch
2018/0087260 A1 * 3/2018 Priester ..... E03F 5/0407
2018/0363284 A1 * 12/2018 Casey ..... E03F 5/06

* cited by examiner

*Primary Examiner* — Reinaldo Sanchez-Medina
*Assistant Examiner* — Nicole Gardner
(74) *Attorney, Agent, or Firm* — Patterson Intellectual Property Law, P.C.; Edward D. Lanquist, Jr.; Alex H. Huffstutter

(57) ABSTRACT

A threshold drain system for redirecting water entering an elevator shaft at an opening thereof is provided. The threshold drain system may include a catch channel and a sill plate. The catch channel may include a forward wall connectable to an interior wall of the elevator shaft along and below the threshold. The sill plate extends from a rearward wall of the catch channel and is offset rearward relative to at least a portion of a vertical surface of the finished floor facing the elevator shaft to define a rearward offset. The forward wall may include a flange extending from an upper end of the forward wall at an elevation lower than a bottom of the sill plate so as to define a vertical offset. The rearward offset and the vertical offset at least in part define a passageway configured to direct the water into the catch channel.

27 Claims, 15 Drawing Sheets

INTEGRATED ELEVATOR SILL DRAIN

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

1. Field of the Invention

The present invention relates generally to a sill drain system for installation at an opening to an elevator shaft.

2. Description of the Prior Art

Nearly all multi-story buildings are required to have a fire prevention system installed. Such fire prevention systems can distribute large amounts of water on any given floor of the building. Often is the case, however, that such multi-story buildings are not well-equipped to accommodate the drainage of such large volumes of water. Much of this water may tend to flow into an elevator shaft of the building and cause extensive damage to elevator equipment located within the elevator shaft if the water is not properly diverted away from the elevator shaft and out of the building.

Modern elevator installations, and by codes 'Fireman Access Elevators', must include drainage systems to divert water entering an elevator shaft out of and away from the elevator shaft. Structural restrictions of a given building may limit the placement of drain systems, especially when retrofitting is necessary to bring a building up to codes.

Drains along elevator thresholds are not typical. Typically, trench drains are installed in the elevator lobby floors. These floor drains are particularly unsightly and ineffective at fully preventing water from entering an elevator shaft.

Very few drain systems are positioned on a shaft side of an elevator (i.e., within the elevator shaft below a shaft door sill). Generally, any such drain system is "open" to the elevator shaft and merely catches free falling water after it has passed over a sill to the elevator shaft or through holes disposed in the sill. The open system may allow excess water which does not fall perfectly into its catch plate positioned within an elevator shaft to enter a main part of the elevator shaft and cause damage to elevator equipment. Water which is directed over the sill and into a catch plate is redirected and freely discharged into at least one channel along at least one shaft wall. This system is unsightly, however, it is slightly more effective than a floor drain since it is positioned at the portion of entry to the elevator shaft.

BRIEF SUMMARY

There exists a need for an improved drain along a threshold to an elevator shaft, specifically with regard to functionality and aesthetics. It is an object of the present invention to provide a new threshold drain system which features an aesthetically pleasing sill plate connected to a catch channel and configured so that water may enter the catch channel between a forward edge of the sill plate and a finished floor leading to the elevator shaft. Though primarily design for fireman service elevators, the new threshold drain system is customizable and may be installed on other elevator systems and may even be used to evacuate water in parking garage applications. The new threshold drain system further includes a stepped (or angled) portion connected to the catch channel and positioned lower than the sill plate in order to prevent foreign items from entering the catch channel between the forward edges the sill plate and the finished floor, while also directing water therethrough.

In one embodiment, a threshold drain system is provided for redirecting water entering an elevator shaft from a finished floor along the threshold of the finished floor. The threshold drain system includes a catch channel and a sill plate. The catch channel includes a bottom portion, a forward wall, a flange, and a rearward wall. The forward wall extends upwardly from the bottom portion and has an upper end. The flange extends forward from the upper end of the forward wall. The rearward wall is spaced apart from the forward wall and extends upwardly from the bottom portion. The sill plate is configured to extend from an upper portion of the rearward wall toward the forward wall. The sill plate and the forward wall may be configured such that a bottom of the sill plate is offset vertically relative to the upper end of the forward wall in order to define a vertical offset.

The vertical offset of such a threshold drain system may at least in part define a passageway configured to direct water from the finished floor adjacent to the elevator shaft into the catch channel along the forward wall when the catch channel is installed.

The flange of such a threshold drain system may further include a first transverse portion which extends transversely from the upper end of the forward wall.

The flange of such a threshold drain system may further include a second lip portion extending upwardly from the first transverse portion of the flange. The sill plate and the flange are configured such that a forward edge of the sill plate is offset rearward relative to the second lip portion of the flange to at least partially define a rearward offset.

The rearward offset and the vertical offset of such a threshold drain system may at least in part define a passageway configured to direct water from the finished floor adjacent the elevator shaft into the catch channel along the forward wall when the catch channel is installed.

The flange of such a threshold drain system may further include a third seal portion extending forward from an upper edge of the second lip portion. The third seal portion may be configured to extend into the finished floor when the catch channel is installed.

The flange of such a threshold drain system may be upwardly inclined and planar.

The flange of such a threshold drain system may further include a distal end portion configured to extend into the finished floor when the catch channel is installed.

Such a threshold drain system may further include a plurality of horizontal support brackets spaced apart along a length of the forward wall. The plurality of support brackets may extend between the rearward wall and the forward wall. The plurality of support brackets may be configured to support the sill plate.

Each support bracket of such a threshold drain system may have a forward end with a downwardly extending flange connected to the forward wall.

The sill plate of such a threshold drain system may include an upper sill plate surface configured to be positioned higher than the finished floor when such that water from the finished floor is directed into the vertical offset when the catch channel is installed.

The sill plate of such a threshold drain system may include a plurality of auxiliary drain holes for directing excess water running rearward past a forward edge of the sill plate into the catch channel.

The bottom portion of such a threshold drain system may include at least one discharge hole. Such a threshold drain system may further including discharge plumbing for directing water received by the catch channel away from the elevator shaft. The discharge plumbing may be connected to the at least one discharge hole. The discharge plumbing may be connectable to a plumbing system of a building where the threshold drain system is to be installed.

The rearward wall of such a threshold drain system may include a plurality of openings for providing access to an interior of the catch channel. Each opening may have an access panel removably attached to the opening.

Such a threshold drain system may further include a fascia mount extending downwardly from the bottom portion. The fascia mount may be positioned closer to the rearward wall than the forward wall. The fascia mount may be configured to receive a fascia piece when the catch channel is installed.

In another embodiment, a method of installing a drain pan system along an opening of an elevator shaft of a building is provided. The method may include the steps of: (a) connecting a catch pan to an interior wall of the elevator shaft along and below the opening; and (b) forming a passageway into an interior of the catch pan along at least a portion of a flange connected to a forward wall of the catch pan.

Such a method may further include the step of connecting at least one discharge hole of the catch pan to a plumbing system of the building.

Step (a) of such a method may further include positioning a fastener through the forward wall of the catch pan to connect the catch pan to the interior wall of the elevator shaft. The fastener may be connected directly to at least one of the interior wall the elevator shaft or a hoist-way channel system of the elevator shaft Step (b) of such method may further include positioning a sill on top of the catch pan. A forward edge of the sill may be spaced apart from a threshold by a rearward offset to define the passageway. The threshold may be part of a finished floor and may be defined along the opening of the elevator shaft.

Step (b) of such method may further include: positioning a removable spacer adjacent to the forward edge of the sill, the spacer extending upwardly from a portion of the flange; installing a floor finish proximate to the opening of the elevator shaft, the floor finish abutting the spacer; and removing the spacer to create the passageway.

Such a method may further include the step of mounting a fascia piece to a fascia mount extending downward from a bottom portion of the catch pan. The fascia piece may be configured to create a uniform vertical surface between vertically sequential openings inside the elevator shaft.

In another embodiment, an installed threshold drain system is provided for redirecting water entering an opening of an elevator shaft from a finished floor. The threshold drain system includes at least a catch channel and a sill plate. The catch channel includes at least a bottom portion, a forward wall, and a rearward wall. The forward wall extends upwardly from the bottom portion. The rearward wall is spaced apart from the forward wall and extends upwardly from the bottom portion. The sill plate is configured to extend from an upper portion of the rearward wall toward the forward wall. The sill plate and the finished floor may be configured such that a forward edge of the sill plate is offset rearward relative to at least a portion of a vertical finished floor surface of the finished floor facing the elevator shaft to define a rearward offset for directing the water into the catch channel along the forward wall.

A majority of the rearward offset of such an installed threshold drain system may be positioned forward of the forward wall.

Alternatively, a majority of the rearward offset of such an installed threshold drain system may be positioned rearward of the forward wall.

The forward wall of such an installed threshold drain system may include an upper end with a flange extending from the upper end along a majority of a length of the forward wall. At least a portion of the flange may be configured to extend into the finished floor.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof, and the like.

Unless specifically stated otherwise, any part of the apparatus of the present disclosure may be made of any appropriate or suitable material including, but not limited to, metal, alloy, polymer, polymer mixture, wood, composite, or any combination thereof.

Figure 1:
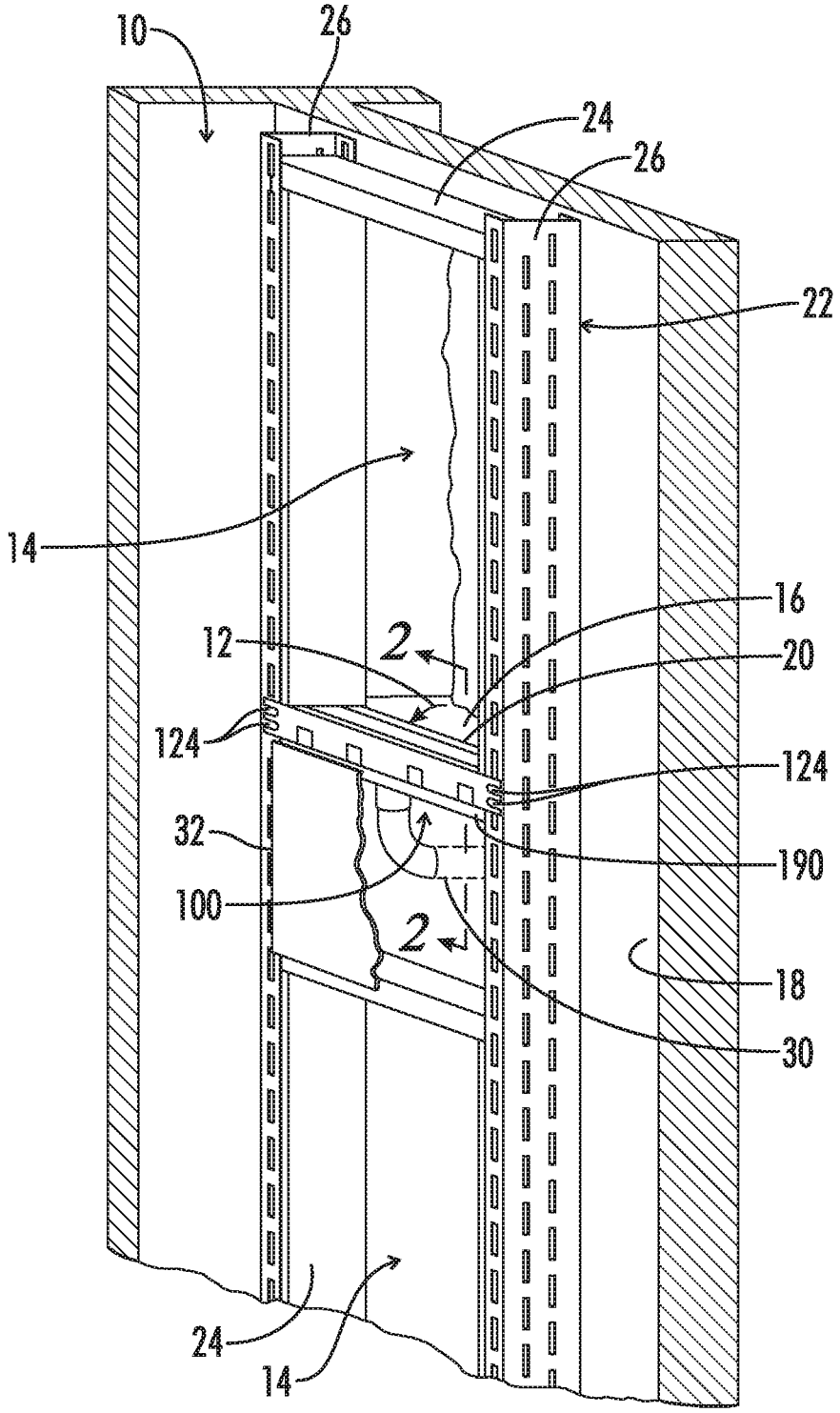
FIG. 1 is a perspective view of a threshold drain system installed an elevator shaft in accordance with an embodiment of the present invention.
Figure 2:
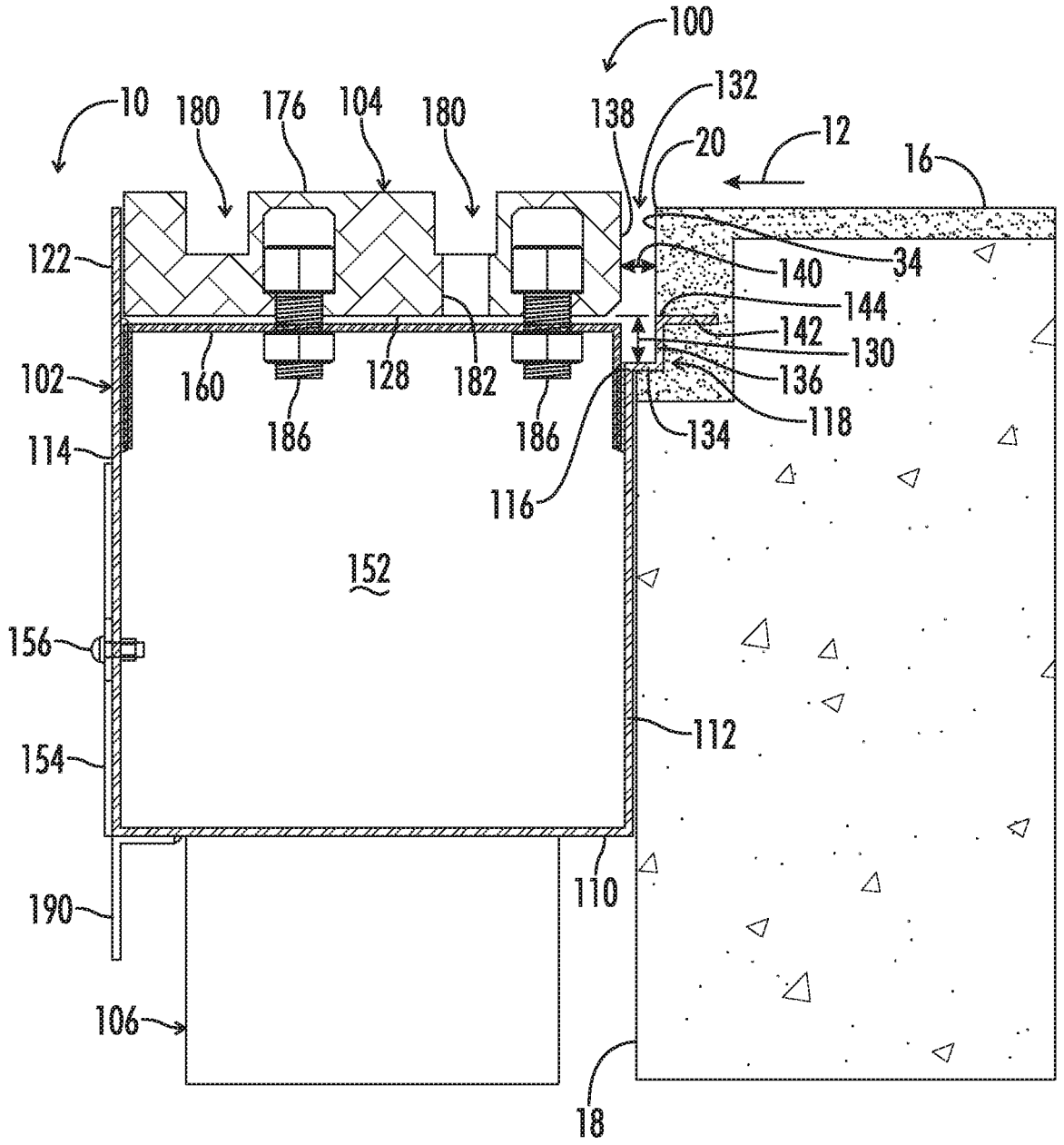
FIG. 2 is a cross-sectional view of the threshold drain system and an interior wall of the elevator shaft taken along line 2-2 of FIG. 1.

Referring to FIGS. 1 and 2, a first embodiment of a threshold drain system 100 is shown installed in an elevator shaft 10 of a building (not shown). The threshold drain system 100 may also be referred to herein as a drain pan system 100. The threshold drain system 100 may be designed for redirecting water 12 entering an opening 14 of the elevator shaft 10 from a finished floor 16 adjacent to the elevator shaft 10. The threshold drain system 100 may be connected to an interior wall 18 of the elevator shaft 10 along and below a threshold 20 of the finished floor 16, which is open to the elevator shaft 10. The threshold 20 of the finished floor 16 spans the width of the opening 14.

In certain embodiments, the threshold drain system 100 may be connected to a hoist-way channel system 22 which is connected between the interior wall 18 of the elevator shaft 10 and the threshold drain system 100. The hoist-way channel system 22 may be manufacturer specific and may be pre-installed into the elevator shaft 10. The hoist-way channel system 22 typically includes at least an entrance frame 24 with entrance support rails 26 along the sides of each opening 14 of the elevator shaft 10 and a rail system (not shown) for guiding a path of an elevator (not shown) vertically in the elevator shaft 10. The threshold drain system 100 may be customized and sized in order to be compatible with any manufacturer's hoist-way components and/or specific to the elevator shaft 10 and dimensions of the threshold 20. The threshold drain system 100 may be utilized as a retrofit system in existing buildings or may be installed in new construction.

Figure 3:
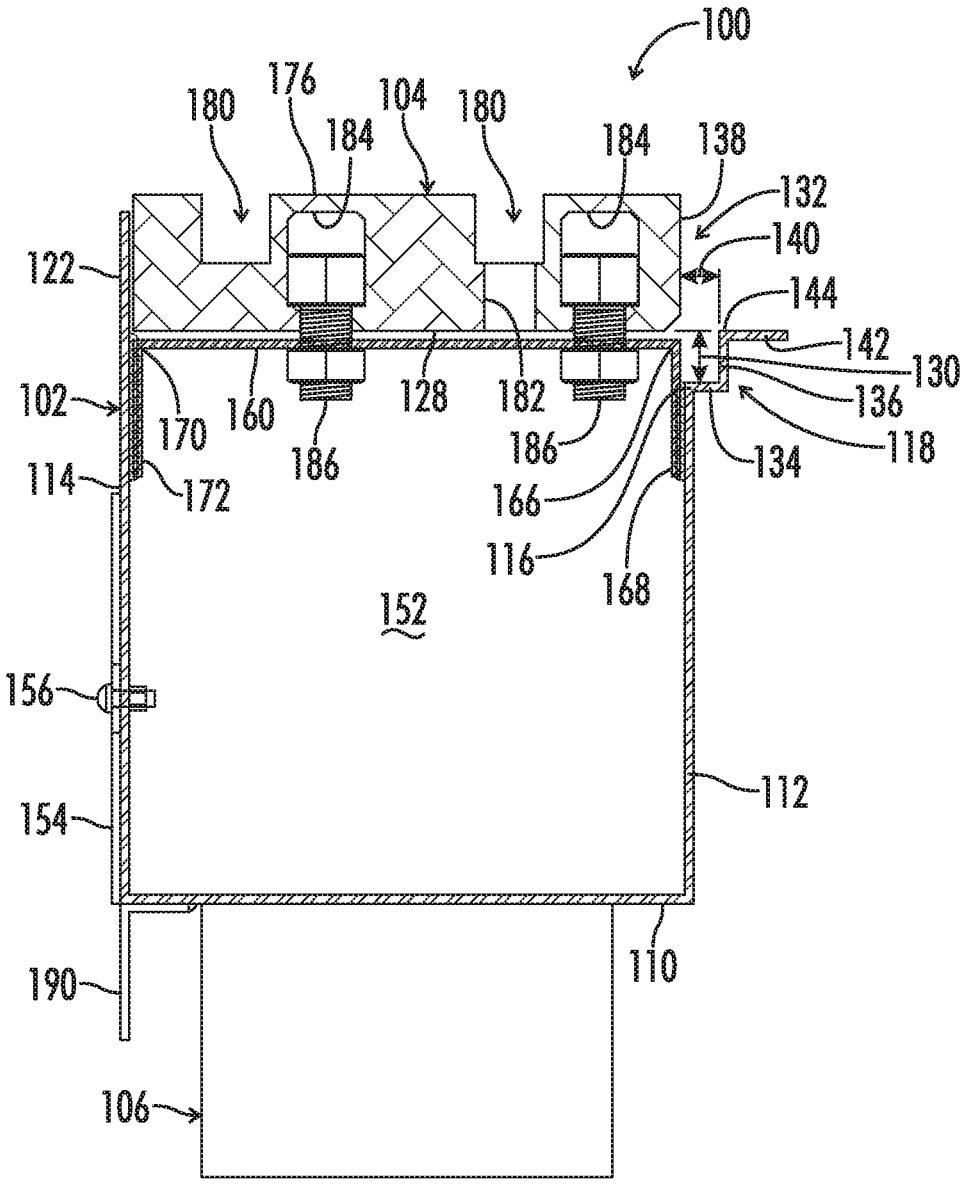
FIG. 3 is a cross-sectional view of the threshold drain system taken along the line 2-2 of FIG. 1.
Figure 4:
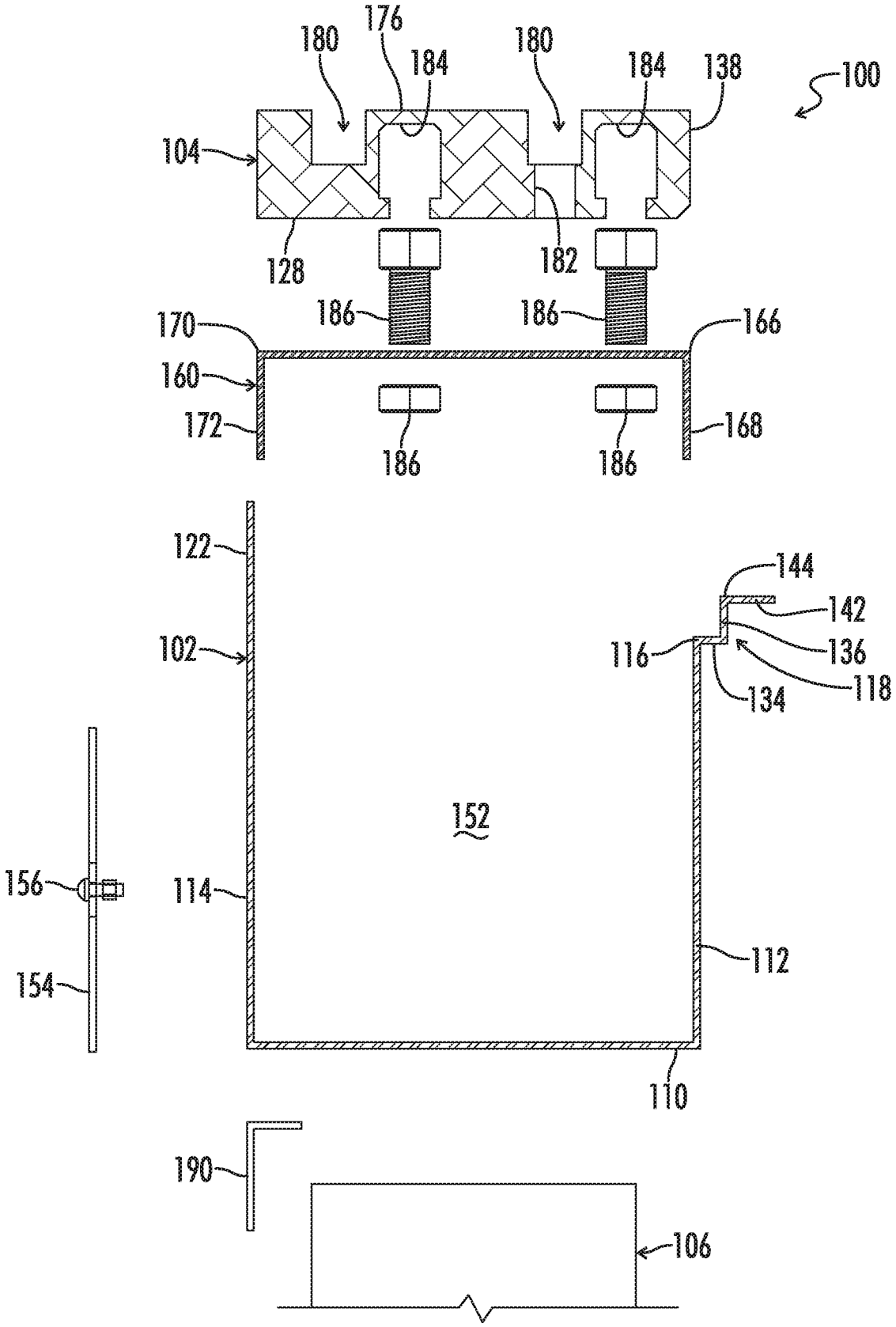
FIG. 4 is an exploded cross-sectional view of the threshold drain system of FIG. 3.

Referring to FIGS. 2-7, detailed views of the threshold drain system 100 are shown. Specifically referring to FIGS. 2-4, cross-sectional views of the threshold drain system 100 are shown. FIG. 2 shows the threshold drain system 100 installed and connected to the interior wall 18 of the elevator shaft 10. FIGS. 3-4 show the threshold drain system 100 uninstalled from the elevator shaft 10 (i.e., the elevator shaft is not shown). The threshold drain system 100 may include a catch channel 102, a sill plate 104, and discharge plumbing 106.

Figure 8:
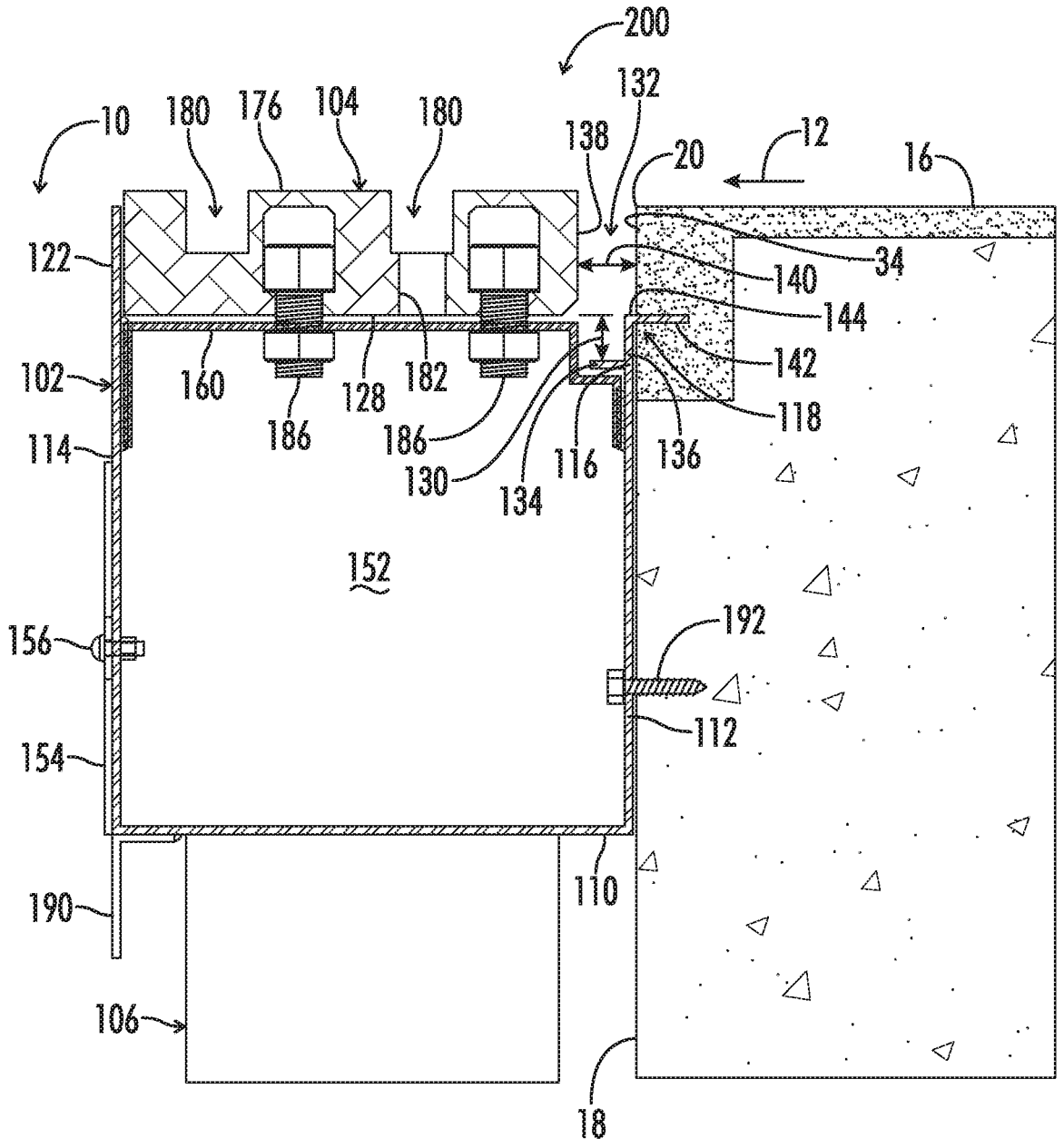
FIG. 8 is a cross-sectional view of a threshold drain system connected to an interior wall of an elevator shaft in accordance with another embodiment of the present invention.

The catch channel 102 may also be referred to herein as a catch pan 102. The catch channel 102 may include a bottom portion 110, a forward wall 112, and a rearward wall 114. The forward wall 112 may extend upwardly from the bottom portion 110. The forward wall 112 may include an upper end 116. In some embodiments, the forward wall 112 may be connected directly to the interior wall 18 of the elevator shaft 10, as shown in FIG. 8. In other embodiments, the forward wall 112 may be connected indirectly to the interior wall 18 of the elevator shaft 10 via the hoist-way channel system 22, as shown in FIG. 1. The rearward wall 114 may be spaced apart from the forward wall 112 and may extend upwardly from the bottom portion 110. The catch channel 102 may also include end walls extending upwardly from ends of the bottom portion 110 that span between the forward wall 112 and the rearward wall 114.

Figure 5:
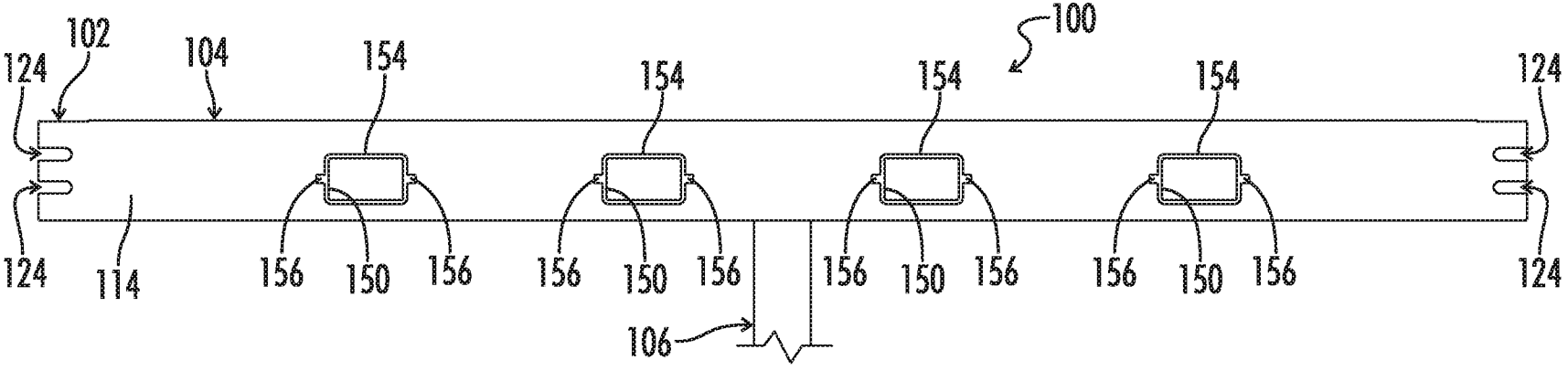
FIG. 5 is an elevational view of a rearward wall of a catch channel of the threshold drain system of FIG. 1.
Figure 6:
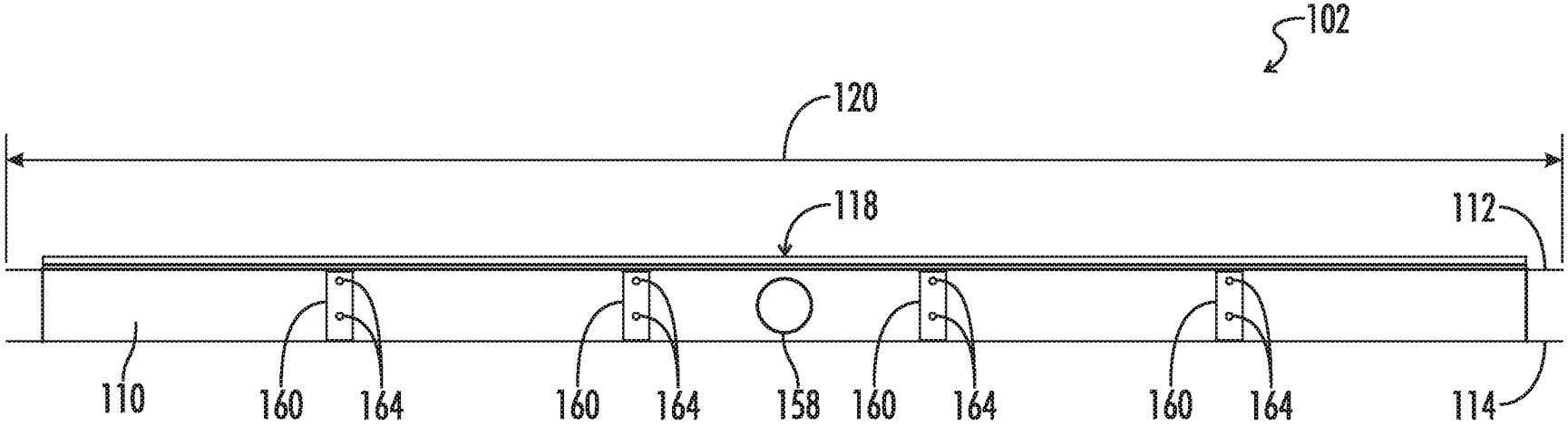
FIG. 6 is a top plan view of the catch channel of the threshold drain system of FIG. 1.
Figure 7:
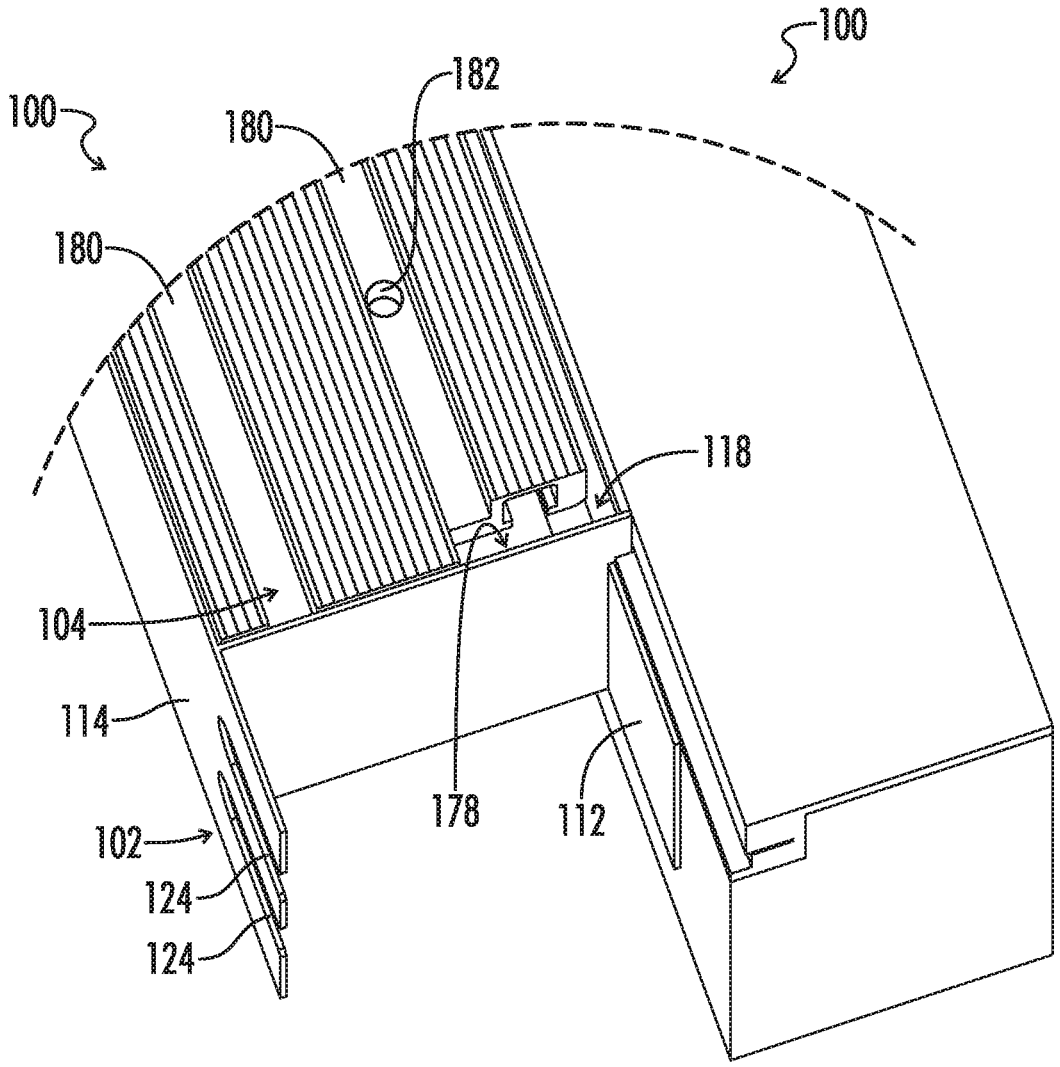
FIG. 7 is an enlarged perspective view of an end of the threshold drain system of FIG. 1.

As can best be seen in FIGS. 6 and 7, both the forward wall 112 and the rearward wall 114 may extend beyond the end walls. As can best be seen in FIGS. 1, 5, and 7, the rearward wall 114 may include connector slots 124 extending inwardly along the rearward wall 114 from either end. Although not shown, the forward wall 112 may also include connector slots in certain embodiments. As can best be seen in FIG. 1, the connector slots 124 may be configured to receive fasteners (not shown) for connecting the catch channel 102 to the entrance support rails 26 of the hoist-way channel system 22 when the hoist-way channel system 22 is present in the elevator shaft 10.

The catch channel 102 may further include a flange 118. The flange 118 may extend forwardly from the upper end 116 of the forward wall 112 away from the rearward wall 114. The flange 118 may span at least a majority of a length 120 of the forward wall 112. The flange 118 should also span the width of both the opening 14 along the threshold 20 of the finished floor 16. This span prevents the water 12 from the finished floor 16 from passing between the forward wall 112 and the interior wall 18 of the elevator shaft 10 on either end of the flange 118.

The sill plate 104 may also be referred to herein as a sill 104. The sill plate 104 may be configured to extend from an upper portion 122 of the rearward wall 114 toward the forward wall 112. The sill plate 104 and the forward wall 112 may be configured such that a bottom 128 of the sill plate 104 is offset vertically relative to the upper end 116 of the forward wall 112 to define a vertical offset 130. The vertical offset 130 may at least in part define a passageway 132. As can best be seen in FIG. 2, the passageway 132 may be configured to direct the water 12 from the finished floor 16 adjacent to the elevator shaft 110 into the catch channel 102 along the forward wall 112 when the catch channel 102 is installed.

The flange 118 may include a first transverse portion 134 that that extends transversely from the upper end 116 of the forward wall 112. The first transverse portion 134 may also be referred to herein as a step portion 134 or a transversely extending flange 134. As can best be seen in FIGS. 2-4, the first transverse portion 134 extends forward from the forward wall 112 (i.e., away from the rearward wall 114). When installed as shown in FIG. 2, the first transverse portion 134 of the flange 118 extends at least partially beyond the interior wall 18 of the elevator shaft 10. In other embodiments (not shown), the first transverse portion 134 may terminate flushly with the interior wall 18 of the elevator shaft 10, and the forward wall 112 may be spaced apart from the interior wall 18 of the elevator shaft 10. In certain embodiments (not shown), the first transverse portion 134 may extend both forward and rearward from the forward wall 112, however, in the first embodiment at least a majority of the first transverse portion 134 extends forward.

The flange 118 may further include a second lip portion 136 that extends upwardly from the first transverse portion 134. The second lip portion 136 may also be referred to herein as an upward extending lip 136. The sill plate 104 and the flange 118 may be configured such that a forward edge 138 of the sill plate 104 is offset rearward relative to the second lip portion 136 of the flange 118 to at least partially define a rearward offset 140. The rearward offset 140 and the vertical offset 130 may at least in part define the passageway 132, as described above. The second lip portion 136 may be aligned vertically with the threshold 20 of the finished floor 16.

The flange 118 may further include a third seal portion 142. The third seal portion 142 may also be referred to herein as a forward extending sealing lip 142. The third seal portion 142 may extend from an upper edge 144 of second lip portion 136. As can best be seen in FIG. 2, the third seal portion 142 may be configured to extend into the finished floor 16 when the catch channel 102 is installed. The third seal portion 142 is designed to prevent the water 12 from the finish floor 16 from passing between the forward wall 112 of the catch channel 102 and the interior wall 18 of the elevator shaft 10. The third seal portion 142 further functions as a structural support to connect the catch channel 102 to the elevator shaft 10. In certain embodiments (not shown), one or both of the second lip portion 136 and the third seal portion 142 may be absent and a sealant may be applied between at least flange 118 and/or the forward wall 112 and the interior wall 18 of the elevator shaft 10 in order to prevent the water 12 from passing there between.

Referring to FIG. 5, an elevational view of the rearward wall 114 is shown. The rearward wall 114 may include a plurality of openings 150 which provide access to an interior 152 of the catch channel 102. The interior 152 of the catch channel 102 may be defined above the bottom portion 110, below the bottom 128 of the sill plate 104, and between the forward wall 112, the rearward wall 114, and the end walls. The plurality of openings 150 may be spaced along the rearward wall 114. Access to the interior 152 of the catch channel 102 may be particularly important during installation of the threshold drain system 100, or later for cleaning or retrieval of foreign objects (e.g., cellular phones, keys, or the like) which may possibly enter the interior 152 of the catch channel 102 through the passageway 132. Each opening 150 may include an access panel 154 removably attached to the opening 150. The access panel 154 may be attached to its respective opening 150 using access panel fasteners 156 positioned on either side of the access panel 154 and extending through the rearward wall 114. In certain embodiments, the access panel 154 may include a watertight seal (not shown) disposed between the access panel 154 and its respective opening 150.

Referring to FIG. 6, an upper plan view of the catch channel 102 is shown. The bottom portion 110 of the catch channel 102 may include at least one discharge hole 158. As can best be seen in FIGS. 2-5, the at least one discharge hole 158 may be connected to the discharge plumbing 106. The discharge plumbing 106 may be configured to direct the water 12 received by the interior 152 of the catch channel 102 away from the elevator shaft 10. As can best be seen in FIG. 1, the discharge plumbing 106 may be connected to a plumbing system 30 of the building. The plumbing system 30 of the building is shown extending through the interior wall 18 of the elevator shaft 10. In other embodiments (not shown), the plumbing system 30 may extend downward along the interior wall 18 of the elevator shaft 10, or a corner thereof. The at least one discharge hole 158 and the discharge plumbing 106 should be sufficiently sized to meet various code requirements with respect to discharge flow rates. This size and the number of discharge holes 158 is customizable.

As can best be seen in FIG. 6, the catch channel 102 may further include a plurality of horizontal support brackets 160. The plurality of horizontal support brackets 160 may be spaced apart along the length 120 of the forward wall 112. The plurality of horizontal support brackets 160 may extend between the forward wall 112 and the rearward wall 114. Each support bracket 160 may include at least one hole 164 for connecting with the sill plate 104. Each support bracket 160 may be aligned with a respective opening 150 defined in the rearward wall 114 to aid in installation of the sill plate 104. As can best be seen in FIGS. 2 and 3, the plurality of horizontal support brackets 160 may be configured to support the sill plate 104. As can best be seen in FIGS. 3 and 4, each support bracket 160 may have a forward end 166 with a first downwardly extending flange 168 connected to the forward wall 112. Each support bracket 160 may further have a rearward end 170 with a second downwardly extending flange 172 connected to the rearward wall 114.

As can best be seen in FIG. 2, the sill plate 104 may include an upper sill plate surface 176. The upper sill plate surface 176 may be configured to be positioned higher than the finished floor 16 when the threshold drain system 100 is installed. The higher positioning of the upper sill plate surface 176 relative to the finished floor 16 is designed to help direct the water 12 from the finished floor 16 into passageway 132.

Referring to FIG. 7, an enlarged detailed perspective view of an end of the threshold drain system 100 is shown. The sill plate 104 may include an auxiliary drain opening 178 at each end of the sill plate 104. Each auxiliary drain opening 178 extends inwardly from a respective end of the sill plate 104 and extends rearwardly from the forward edge 138 of the sill plate 104. In some embodiments (not shown), the auxiliary drain opening 178 extends fully between the forward edge 138 of the sill plate 104 and a rearward edge adjacent to the upper portion 122 of the rearward wall 114.

The auxiliary drain openings 178 increase the size of the passageway 132 near the ends of the sill plate 104. The auxiliary drain openings 178, when implemented, may be configured to accommodate and direct excess water 12 from the finished floor 16 not receivable by the rearward offset 140 into the interior 152 of the catch channel 102. Additionally, the auxiliary drain openings 178 may enable the threshold drain system 100 to accommodate increased flow rate of the water 12 from the finish floor 16. In some situations, the amount of water 12 passing over the threshold 20 may be higher near the edges. The opening 14 to the elevator shaft 10 may be thought of as a bottleneck with the water 12 from the finished floor 16 converging at the threshold 20. Accordingly, the flow rate of the water 12 passing over the threshold 20 may be higher near the ends of the sill plate 104.

As can best be seen in FIGS. 2-4, the sill plate 104 may include at least one upper channel 180 disposed along the upper sill plate surface 176 between the ends thereof. The at least one upper channel 180 of the sill plate 104 may be connected at its ends to the auxiliary drain openings 178. Accordingly, any water received by the at least one upper channel 180 may be directed into the auxiliary drain openings 178 located at either end. In some embodiments (not shown), the at least one upper channel 180 may include a slopped lower surface configured to assist in directing any water received into the interior 152 of the catch channel 102 via the auxiliary drain openings 178.

The sill plate 104 may further include a plurality of auxiliary drain holes 182 defined in the at least one upper channel 180. The plurality of auxiliary drain holes 182 may be spaced within the at least one upper channel 180 of the sill plate 104 along its length. The plurality of auxiliary drain holes 182, when implemented, may be configured to direct excess water 12 from the finish floor 16, which is not received along the forward edge 138 of the sill plate 104 and which flows rearwardly past the forward edge 138, into the interior 152 of the catch channel 102.

Proper sizing of the passageway 132 for water 12 entering the catch channel 102 and the at least one discharge hole 158 and its associated plumbing is of crucial importance in order to insure a proper draining that meets codes requirements for at least firemen elevators. The cross-sectional area (not shown) of the at least one discharge hole 158 should be at least as great as the cross-sectional area (not shown) of the passageway 132 so the water 12 drains from the catch channel 102 as fast as the water 12 is introduced to the catch channel 102. In embodiments which include the auxiliary drain openings 178 and/or the plurality of drain holes 182, the cross-sectional area of the at least one discharge hole 158 should be at least as great as the combined cross-sectional areas (not shown) of the passageway 132, the auxiliary drain openings 178, and the plurality of auxiliary drain holes 182 when included.

As can best be seen in FIG. 4, the bottom 128 of the sill plate 104 may include at least one slot 184 defined along the length of the sill plate 104. The at least one slot 184 may be configured to slidably receive a plurality of sill plate fasteners 186 from an end thereof. The at least one slot 184 may have a lip adjacent to the bottom 128 of the sill plate 104 to ensure that the sill plate fasteners 186 cannot be vertically removed. As can best be seen in FIGS. 2-4, each sill plate fastener 186 may comprise a nut and bolt. The plurality of sill plate fasteners 186 are configured to connect the sill plate 104 to the plurality of horizontal support brackets 160 of the catch channel 102. By under mounting the sill plate fasteners 186 to the sill plate 104, the upper sill plate surface 176 remains free from unsightly fasteners. Each sill plate faster 186 may be received by the at least one hole 164 of a respective support bracket 160. Access to the sill plate fasteners 186 during installation of the sill plate 104 onto the plurality of horizontal support brackets 160 of the catch channel 102 may be accomplished using the plurality of openings 150 defined in the rearward wall 114.

As can best be seen in FIGS. 2-4, the threshold drain system 100 may further include a fascia mount 190 extending downward from the bottom portion 110. The fascia mount 190 may be positioned closer to the rearward wall 114 than the forward wall 112. As can best be seen in FIG. 1, the fascia mount 190 may be configured to receive a fascia piece 32 when the catch channel 102 is installed. The fascia piece 32 may extend downwardly from the fascia mount 190 to create a uniform vertical surface between the floors of the building inside the elevator shaft 10 (e.g., between the vertically sequential openings 14 to the elevator shaft 10).

Figure 9:
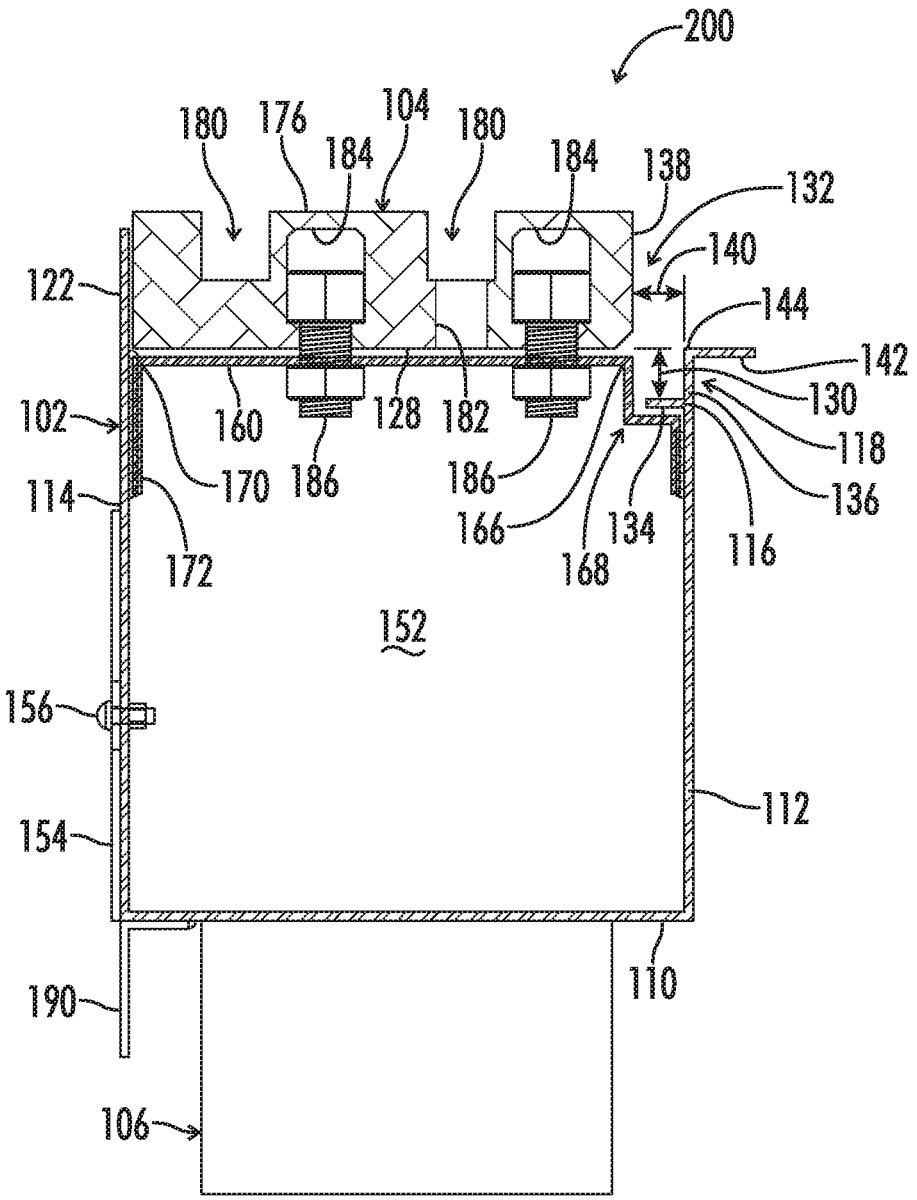
FIG. 9 is a cross-sectional view of the threshold drain system of FIG. 8.
Figure 10:
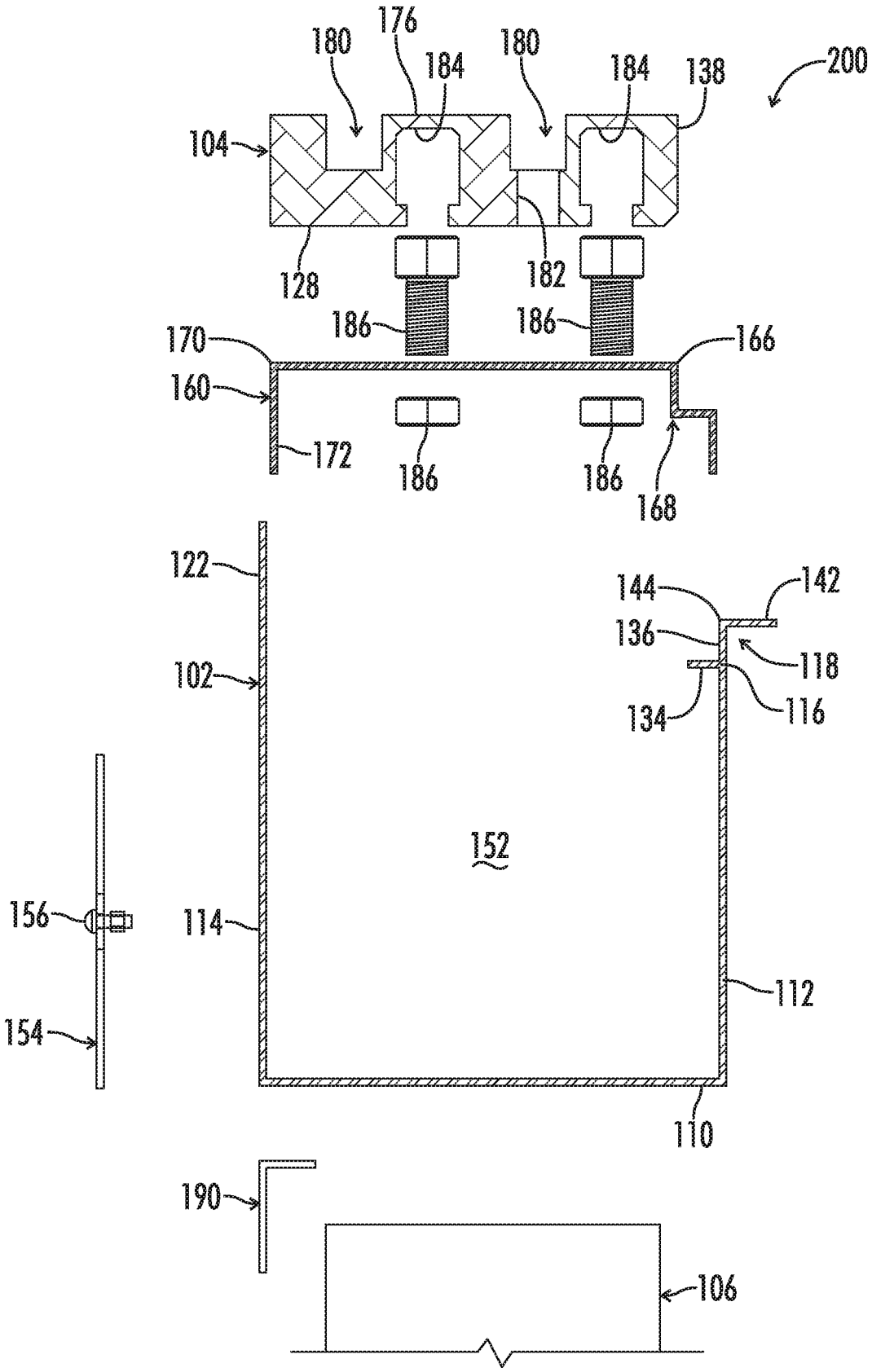
FIG. 10 is an exploded cross-sectional view of the threshold drain system of FIG. 9.

Referring to FIGS. 8-10, a second embodiment of a threshold drain system 200 is shown. Analogous parts of the threshold drain system 200 are numbered similarly to parts of the threshold drain system 100. The following description of the threshold drain system 200 will focus on the features which differ from the threshold drain system 100.

The first transverse portion 134 of the flange 118 of the threshold drain system 200 extends rearward from the forward wall 112 (i.e., toward the rearward wall 114). In certain embodiments (not shown), the first transverse portion 134 of the flange 118 may extend both forward and rearward from the forward wall 112, however, in the second embodiment at least a majority of the first transverse portion 134 of the flange 118 extends rearward.

The second lip portion 136 of the flange 118 of the threshold drain system 200 extends upward from the first transverse portion 134 of the flange 118 and is shown generally aligned with the forward wall 112. The rearward offset 140 may be defined at least in part between the forward edge 138 of the sill plate 104 and the second lip portion 136 of the flange 118. As can best be seen in FIG. 8, the upward extending lip 138 may be aligned generally with the interior wall 18 of the elevator shaft 10. In some embodiments (not shown), the second lip portion 136 may be offset from the forward wall 112 so as to be inlaid into a portion of the finished floor 16 and shift the rearward offset 140 at least partially directly above the forward wall 112. In other embodiments (not shown), such as in new construction, the finished floor 16 may be poured so as to align with the second lip portion 136. In such an embodiment, the threshold 20 of the finished floor 16 would slightly overhang the interior wall 18 of the elevator shaft 10 by a thickness of the second lip portion 136.

The third seal portion 142 of the flange 118 of the threshold drain system 200 may be arranged and connected to the second lip portion 136, similarly to the second lip portion 136 of the flange 118 of the threshold drain system 100.

The plurality of horizontal support brackets 160 of the catch channel 102 of the threshold drain system 200 may be slightly more complex than those of the threshold drain system 100. The first downward extending flange 168 may be shaped to accommodate the first transverse portion 134 of the flange 118 before connecting to the forward wall 112 below the first transverse portion 134. In other embodiments (not shown), the first downwardly extending flange 168 may connect to a free end of first transverse portion 134 of the flange 118.

Finally, the sill plate 104 of the threshold drain system 200 may have a smaller width than the sill plate 104 of the threshold drain system 100 so as to maintain the rearward offset 140 between the forward edge 138 of the sill plate 104 and the threshold 20 of the finished floor 16.

All other characteristics, structures, interactions, connections, and alternative embodiments of the threshold drain system 200 remain similar to those of the threshold drain system 100.

Figure 11:
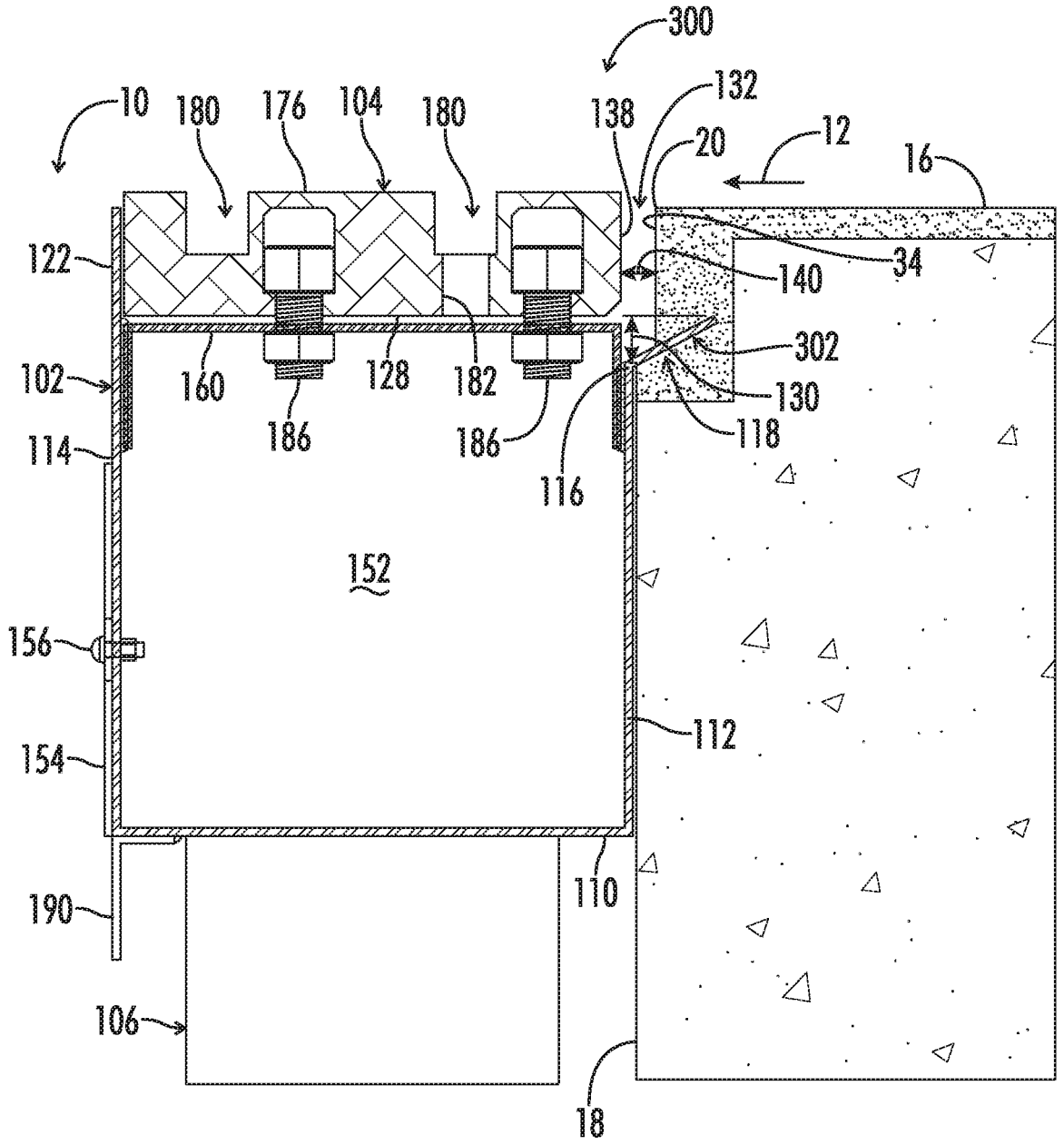
FIG. 11 is a cross-sectional view of a threshold drain system connected to an interior wall of an elevator shaft in accordance with another embodiment of the present invention.
Figure 12:
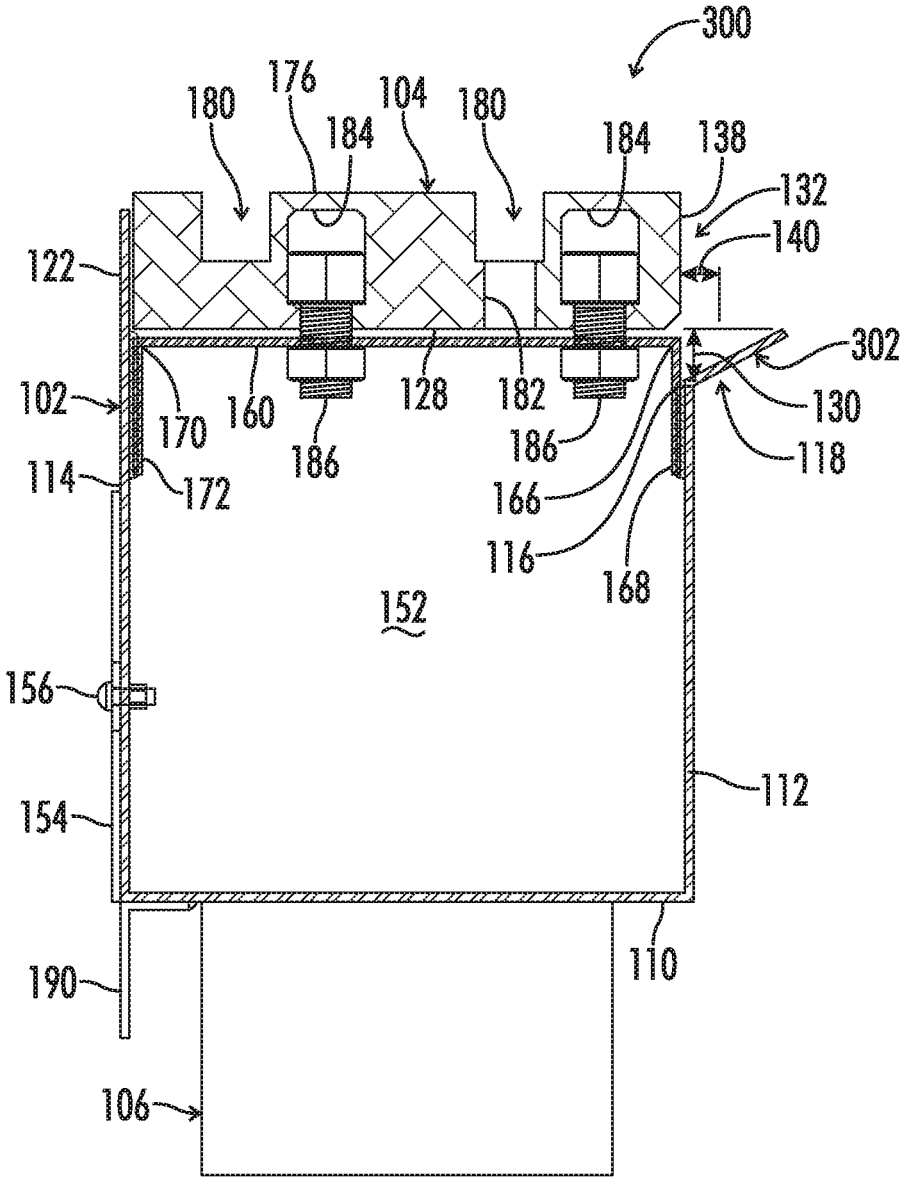
FIG. 12 is a cross-sectional view of the threshold drain system of FIG. 11.
Figure 13:
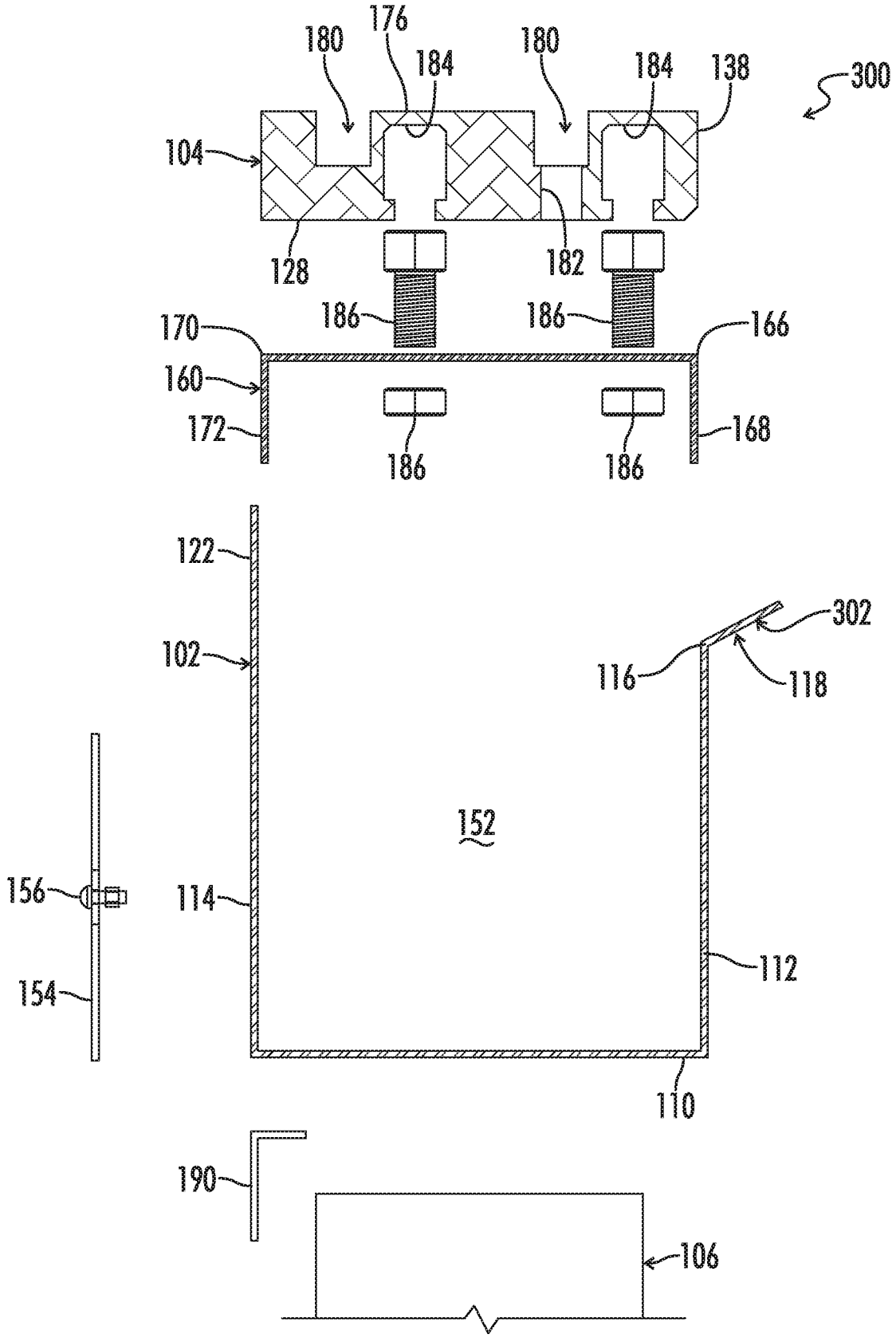
FIG. 13 is an exploded cross-sectional view of the threshold drain system of FIG. 12.
Figure 14A:
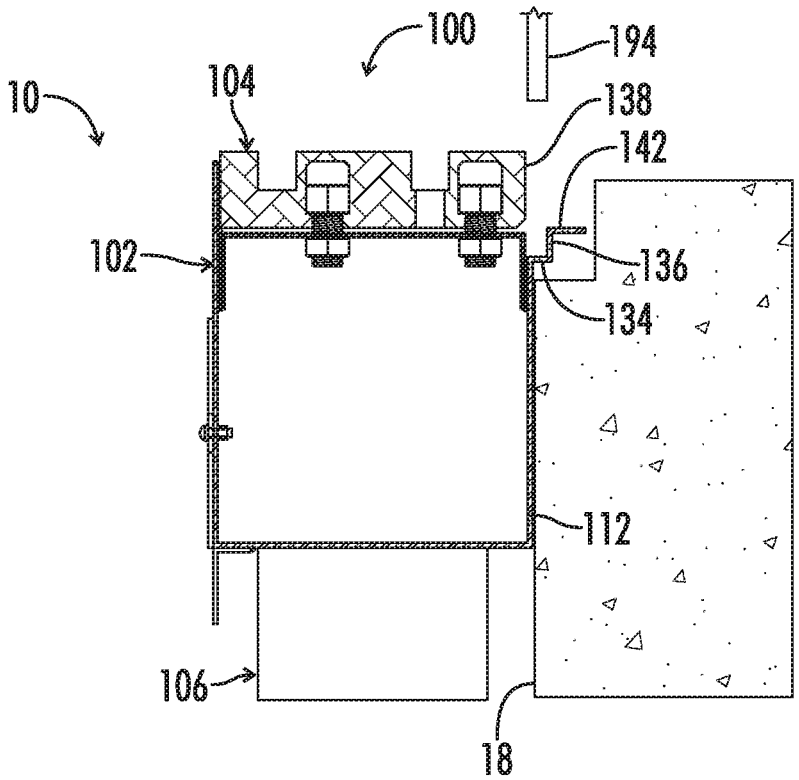
FIG. 14A is a cross-sectional view of the threshold drain system of FIG. 3 attached to an interior wall of the elevator shaft prior to installation of a finished floor.
Figure 14B:
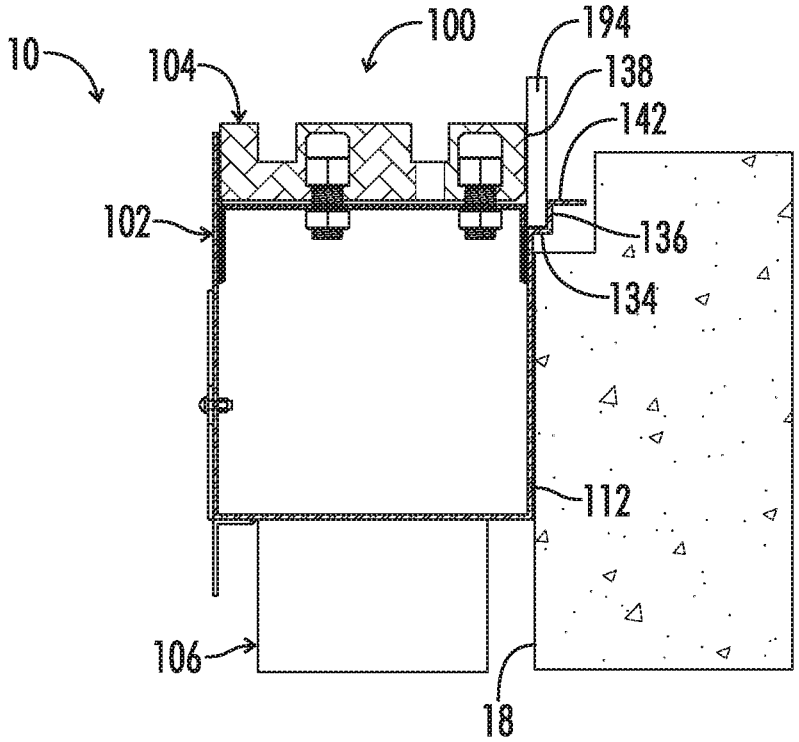
FIG. 14B is a cross-sectional view of the threshold drain system of FIG. 14A with a spacer positioned between the sill plate and a portion of the forward wall of the catch channel of the threshold drain system.
Figure 14C:
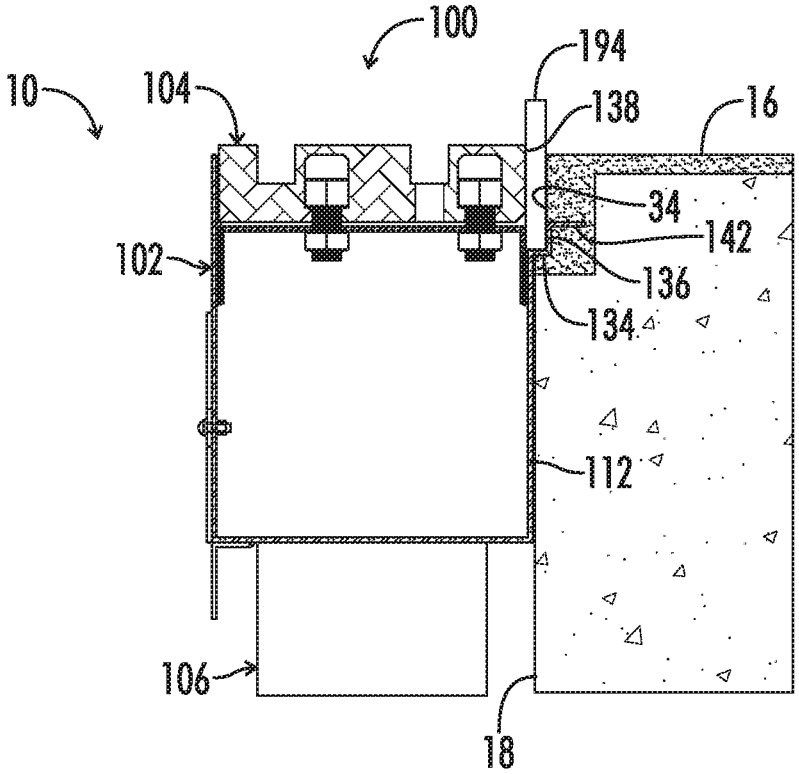
FIG. 14C is a cross-sectional view of the threshold drain system of FIG. 14B with the finished floor installed.
Figure 14D:
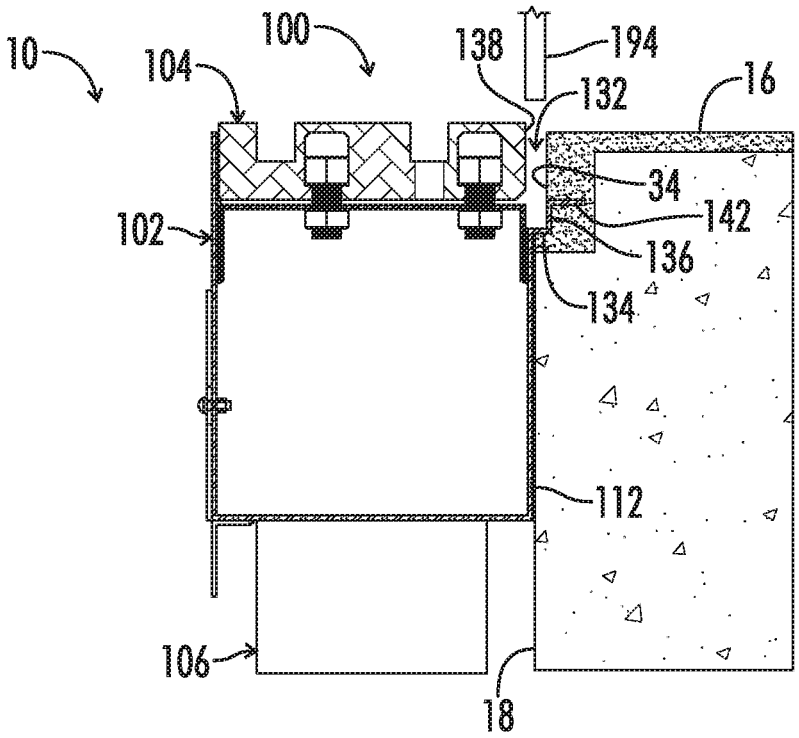
FIG. 14D is a cross-sectional view of the threshold drain system of FIG. 14C with the spacer removed.

Referring to FIGS. 11-13, a third embodiment of a threshold drain system 300 is shown. Analogous parts of the threshold drain system 300 are numbered similarly to parts of the threshold drain system 100. The following description of the threshold drain system 300 will focus on the features which differ from the threshold drain system 100.

The flange 118 of the threshold drain system 300 is planar, thus it does not include the three portions 134, 136, and 142. The flange 118 of the threshold drain system 300 extends forwardly from the upper end 116 of the forward wall 112 and is upwardly inclined. As can best be seen in FIG. 11, the flange 118 of the threshold drain system 300 includes a distal end portion 302, coplanar with the flange 118, which is configured to extend into the finished floor 16 along the threshold 20 when the catch channel 102 is installed. The rearward offset 140 is at least partially defined between the forward edge 138 of the sill plate 104 and a proximal end of the distal end portion 302 of the flange 118.

All other characteristics, structures, interactions, connections, and alternative embodiments of the threshold drain system 300 remain similar to those of the threshold drain system 100.

An alternative embodiment (not shown) of the threshold drain system 300 may include an additional flange extending rearwardly from the upper end 116 of the forward wall 112, similar to the first transverse portion 134 of the flange 118 of the second embodiment of the threshold drain system 200. In this embodiment, the entirety of the flange 118 extending from upper end 116 of the forward wall 112 is configured to extend into the finished floor 16.

In all of the aforementioned embodiments, the sill plate 104 of each threshold drain system 100, 200, 300, when installed, and the finished floor 16 are configured such that the forward edge 138 of the sill plate 104 is offset rearward relative to at least a portion of a vertical finished floor surface 34 of the finished floor 16 extending downwardly from the threshold 20 of the finished floor 16 to at least partially define the rearward offset 140. In the first embodiment and the third embodiment, as shown in FIGS. 2 and 11, a majority of the rearward offset 140 is positioned forward of the forward wall 112. In the second embodiment and the alternate third embodiment, a majority of the rearward offset 140 is positioned rearward of the forward wall 112.

Another embodiment of the disclosure is a method of installing the threshold drain system 100, 200, 300. Each of the threshold drain systems 100, 200, 300 may be installed along opening 14 of elevator shaft 10 according to a similar method of installation. The method of installing any of the threshold drain systems 100, 200, 300 may include the step of connecting the catch channel 102 to the interior wall 18 of the elevator shaft 10 along and below the opening 14. The installation method may further include the step of forming the passageway 132 into the interior 152 of the catch channel 102 along at least a portion of the flange 118 connected to the upper end 116 the forward wall 112.

The installation method may further include the step of attaching the sill plate 104 to the catch channel 102. As mentioned above, the sill plate 104 extends from the upper portion 122 of the rearward wall 114 and is offset rearwardly from at least the threshold 20 of the finished floor 16 so as to define the rearward offset 140. The rearward offset 140 at least in part defines the passageway 132.

The installation method may further include the step of connecting the at least one discharge hole 158 of the bottom portion 110 of the catch channel 102 to the plumbing system 30 of the building. The at least one discharge hole 158 may be connected to the plumbing system 30 using the discharge plumbing 106 of the threshold drain system 100.

In some embodiments, the installation method may further include the step of positioning a fastener 192 through the forward wall 112 of the catch channel 102 to connect the catch channel 102 to the interior wall 18 of the elevator shaft 10. The fastener 192 may be used to connect to the catch channel 102 directly to the interior wall 18 of the elevator shaft 10 (shown in FIG. 8) or indirectly to the interior wall 18 of the elevator shaft 10 via the hoist-way channel system 22 connected to the interior wall 18 of the elevator shaft 10.

Referring to FIGS. 14A-14D, a portion of the installation method is shown. In new construction and retrofit applications in which the finished floor 16 has not yet been installed (FIGS. 14A and 14B), the installation method may further include the step of positioning a removable spacer 194 adjacent to the forward edge 138 of the sill plate 104 (e.g., between the forward edge 138 of the sill plate 104 and the upward extending lip 138 of the forward wall 112 in the first and second embodiments). The spacer 194 includes a lower end shaped similar to and configured to extend upward from a portion of the flange 118 extending from the upper end 116 of the forward wall 112. Next, the installation method may further include the step of installing the finished floor 16 (FIG. 14C) so that it abuts the spacer 194 and an underside of the flange 118, while also filling in any gaps between the forward wall 112 and the interior wall 18 of the elevator shaft 10. The finished floor 16 may be poured (e.g., concrete or the like) or may be applied in some other manner which maintains the structural requirements as mentioned above. Finally, the installation method may further include the step of removing the spacer 194 (FIG. 14D) to create the passageway 132.

In new construction and retrofit applications in which the finished floor 16 has already been installed, the installation method may further include the step of cutting a horizontal or angled receiving channel (not shown) in at least one of the interior wall 18 of the elevator shaft 10 or a downward protruding portion of the finished floor 16 aligned with the interior wall 18. The horizontal receiving channel may be configured to receive a portion of the flange 118 of the forward wall 112 of the catch channel 102. Next, the installation method may further include inserting the portion (e.g., the third seal portion 142 or the distal end portion 302) of the flange 118 into the receiving channel in order to connect the catch channel 102 to the interior wall 18 of the elevator shaft 10.

In some embodiments, the installation method may further include the step of sealing any gap between the forward wall 112 and the interior wall 18 of the elevator shaft 10. And may further include sealing any gap between the flange 118 and the interior wall 18 of the elevator shaft 10.

In some embodiments, the installation method may further include the step of mounting a fascia piece 32 to the fascia mount 190 which extends downward from the bottom portion 110 of the catch channel 102.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A threshold drain system for redirecting water entering an elevator shaft from a finished floor, the threshold drain system comprising:

a catch channel including:

a bottom portion;

a forward wall extending upwardly from the bottom portion, the forward wall having an upper end, the forward wall configured to be attached to an interior wall of the elevator shaft along and below a threshold of the finished floor open to the elevator shaft;

a flange extending forwardly from the upper end of the forward wall; and a rearward wall spaced apart from the forward wall and extending upwardly from the bottom portion, the rearward wall configured to be positioned within the elevator shaft; and a sill plate configured to extend from an upper portion of the rearward wall toward the forward wall, the sill plate and the forward wall being configured such that a bottom of the sill plate is offset vertically relative to the upper end of the forward wall to define a vertical offset.

2. The threshold drain system of claim 1, wherein:

the vertical offset at least in part defines a passageway configured to direct water from the finished floor adjacent the elevator shaft into the catch channel along the forward wall when the catch channel is installed.

3. The threshold drain system of claim 1, wherein:

the flange includes a first transverse portion which extends transversely from the upper end of the forward wall.

4. The threshold drain system of claim 3, wherein:

the flange further includes a second lip portion extending upwardly from the first transverse portion of the flange; and the sill plate and the flange are configured such that a forward edge of the sill plate is offset rearward relative to the second lip portion of the flange to at least partially define a rearward offset.

5. The threshold drain system of claim 4, wherein:

the rearward offset and the vertical offset at least in part define a passageway configured to direct water from the finished floor adjacent the elevator shaft into the catch channel along the forward wall when the catch channel is installed.

6. The threshold drain system of claim 5, wherein:

the flange further includes a third seal portion extending forward from an upper edge of the second lip portion, the third seal portion being configured to extend into the finished floor when the catch channel is installed.

7. The threshold drain system of claim 1, wherein the flange is upwardly inclined and planar.

8. The threshold drain system of claim 7, wherein:

a distal end portion of the flange being configured to extend into the finished floor when the catch channel is installed.

9. The threshold drain system of claim 1, further comprising:

a plurality of horizontal support brackets coupled to and spaced apart along a length of the forward wall, the plurality of support brackets extending between the rearward wall and the forward wall, the plurality of support brackets configured to support the sill plate.

10. The threshold drain system of claim 9, wherein each support bracket has a forward end with a downwardly extending flange connected to the forward wall.

11. The threshold drain system of claim 1, wherein:

the sill plate includes an upper sill plate surface configured to be positioned higher than the finished floor such that water from the finished floor is directed along a forward edge of the sill plate into the vertical offset when the catch channel is installed.

12. The threshold drain system of claim 1, wherein the sill plate includes a plurality of auxiliary drain holes for directing excess water running rearward past a forward edge of the sill plate into the catch channel.

13. The threshold drain system of claim 1, wherein the bottom portion includes at least one discharge hole.

14. The threshold drain system of claim 13, further including discharge plumbing for directing water received by the catch channel away from the elevator shaft, the discharge plumbing connected to the at least one discharge hole.

15. The threshold drain system of claim 14, wherein the discharge plumbing is connectable to a plumbing system of a building where the threshold drain system is to be installed.

16. The threshold drain system of claim 1, wherein:

the rearward wall includes a plurality of openings for providing access to an interior of the catch channel, each opening having an access panel removably attached to the opening.

17. The threshold drain system of claim 1, further including a fascia mount extending downwardly from the bottom portion, the fascia mount positioned closer to the rearward wall than the forward wall, the fascia mount configured to receive a fascia piece when the catch channel is installed.

18. A method of installing a drain pan system along an opening of an elevator shaft of a building, the method comprising the steps of:

(a) connecting a catch pan to an interior wall of the elevator shaft along and below the opening such that the catch pan is positioned within the elevator shaft;

(b) forming a passageway into an interior of the catch pan along at least a portion of a flange connected to a forward wall of the catch pan; and (c) positioning a sill on top of the catch pan, a forward edge of the sill spaced apart from a threshold by a rearward offset to define the passageway, the threshold being part of a finished floor and defined along the opening.

19. The method of claim 18, further comprising:

connecting at least one discharge hole of the catch pan to a plumbing system of the building.

20. The method of claim 18, wherein step (a) further includes positioning a fastener through the forward wall of the catch pan to connect the catch pan to the interior wall of the elevator shaft.

21. The method of claim 20, wherein the fastener is connected directly to at least one of the interior wall of the elevator shaft or a hoist-way channel system of the elevator shaft.

22. The method of claim 18, wherein step (c) further includes:

positioning a removable spacer adjacent to the forward edge of the sill, the spacer extending upwardly from a portion of the flange;

installing a floor finish proximate to the opening of the elevator shaft, the floor finish abutting the spacer; and removing the spacer to create the passageway.

23. The method of claim 18, further comprising:

mounting a fascia piece to a fascia mount extending downward from a bottom portion of the catch pan, the fascia piece configured to create a uniform vertical surface between vertically sequential openings inside the elevator shaft.

24. An installed threshold drain system for redirecting water entering an opening of an elevator shaft from a finished floor, the threshold drain system comprising:

a catch channel including:

a bottom portion;

a forward wall extending upwardly from the bottom portion, the forward wall coupled to an interior wall of the elevator shaft below and along the opening of the elevator shaft; and a rearward wall spaced apart from the forward wall and extending upwardly from the bottom portion, the rearward wall spaced apart from the interior wall of the elevator shaft and positioned within the elevator shaft; and a sill plate configured to extend from an upper portion of the rearward wall toward the forward wall, the sill plate and the finished floor being configured such that a forward edge of the sill plate is offset rearward relative to at least a portion of a vertical finished floor surface of the finished floor facing and open to the elevator shaft to define a rearward offset for directing the water into the catch channel along the forward wall.

25. The installed threshold drain system of claim 24, wherein a majority of the rearward offset is positioned forward of the forward wall.

26. The installed threshold drain system of claim 24, wherein a majority of the rearward offset is positioned rearward of the forward wall.

27. The installed threshold drain system of claim 24, wherein the forward wall includes an upper end with a flange extending from the upper end along a majority of a length of the forward wall, at least a portion of the flange extending into the finished floor.

* * * * *